US005461869A

United States Patent [19]

Ishino et al.

[11] Patent Number: 5,461,869

[45] Date of Patent: Oct. 31, 1995

[54] VUILLEUMIER HEAT PUMP DEVICE

[75] Inventors: Tsutomu Ishino; Masahiro Kitamoto, both of Osaka, Japan

[73] Assignee: Daikin Industries, Ltd., Osaka, Japan

[21] Appl. No.: 295,683

[22] PCT Filed: Dec. 13, 1993

[86] PCT No.: PCT/JP93/01806

§ 371 Date: Aug. 25, 1994

§ 102(e) Date: Aug. 25, 1994

[87] PCT Pub. No.: WO94/15157

PCT Pub. Date: Jul. 7, 1994

[30] Foreign Application Priority Data

Dec. 28, 1992 [JP] Japan ..... 4-347700

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS 3,802,211 4/1974 Bamberg et al. ..... 62/6
4,642,988 2/1987 Benson ..... 60/520 X
5,406,801 4/1995 Inoue et al. ..... 62/6

FOREIGN PATENT DOCUMENTS 63-311050 12/1988 Japan .
1137164 5/1989 Japan .
24174 1/1990 Japan .
4198671 7/1992 Japan .

*Primary Examiner*—Christopher Kilner
*Attorney, Agent, or Firm*—Sixbey, Friedman, Leedom & Ferguson; Gerald J. Ferguson, Jr.

[57] ABSTRACT

A vuilleumier heat pump device comprises: a hot-side heat pump (2) in which a hot side displacer (22) is housed in a hot side cylinder (21); and a cold-side heat pump (3) in which a cold side displacer (32) is housed in a cold side cylinder (31). Rods (23, 33) respectively connected to the displacers (22, 32) are connected to each other through a connection mechanism (4). In the vuilleumier heat pump device, a volume of the cold side rod (33) in a middle-temperature space (35) is adjusted. In this case, a rotation speed of a crank shaft (42) of the connection mechanism (4) is detected, a volume of the rod in a middle-temperature space (35) according to the rotation speed is calculated, and then the volume of the cold side rod (33) in a middle-temperature space (35) is adjusted so as to reach the calculated volume of the rod.

6 Claims, 16 Drawing Sheets

VUILLEUMIER HEAT PUMP DEVICE

TECHNICAL FIELD

This invention relates to a vuilleumier heat pump device and particularly relates to a countermeasure for controlling driving power of the vuilleumier heat pump device.

BACKGROUND ART

In general, a vuilleumier heat pump device used in such as an air conditioner comprises a hot-side heat pump and a cold-side heat pump, as disclosed in Japanese Patent Application laying Open Gazette No. 1-187164. In the vuilleumier heat pump device, each of the heat pumps is so composed that a displacer is housed in a cylinder. Both the displacers of the hot-side and cold-side heat pumps are connected to each other so as to reciprocate at a set phase angle (e.g., 90°). A hot space and a middle-temperature space in the hot side cylinder are communicated with each other through a hot side passage, while a cold space and a middle-temperature space in the cold side cylinder are communicated with each other through a cold side passage.

Reciprocations of both the displacers change volumes of respective spaces above-mentioned in the cylinders, so that a working gas is changed in pressure to form a thermodynamic cycle. Heat input is conducted at a heater and a cooler on the hot side and cold side passages, while heat radiation is conducted at middle-temperature heat exchangers on both the passages. Further, in the hot-side heat pump, heat is stored in a regenerator on the hot side passage when a working gas moves from the hot space to the middle-temperature space, while heat stored in the regenerator is regenerated when a working gas moves from the middle-temperature space to the hot space. In the cold-side heat pump, heat is stored in a regenerator on the cold side passage when a working gas moves from the middle-temperature space to the cold space, while heat stored in the regenerator is regenerated when a working gas moves from the cold space to the middle-temperate space.

In the above-mentioned vuilleumier heat pump device, a rod of one displacer is connected to a rod of another displacer via a connection mechanism. A crank shaft of the connection mechanism is connected to an auxiliary driving motor as an auxiliary driving power source. The auxiliary driving motor enables the displacers to reciprocate. That is, when a rotation speed of the crank shaft increases over its self operating point, the auxiliary driving motor gives auxiliary driving power to the crank shaft. On the contrary, when the rotation speed of the crank shaft decreases below its self operating point, the auxiliary driving motor gives a reverse load to the crank shaft.

In detail, as shown in FIG. 4, a shaft power (shaft work) Wt of the crank shaft increases linearly as the rotation speed N of the crank shaft increases. In contrast to this, a power loss L which is the sum of a mechanical loss and a flow loss increases in a curve as the rotation speed N of the crank shaft increases. Both the variation characteristics of the shaft power Wt and the power loss L are intersected at a set rotation speed N. The point of intersection is the self operating point S.

At the self operating point S, the shaft power Wt is balanced with the power loss L so that power supply to the auxiliary driving motor is interrupted. When the rotation speed N increases over the self operating point S, the power loss L exceeds the shaft power Wt so that the auxiliary driving power is required (See A1 in FIG. 4). As a result, the auxiliary driving motor is activated.

On the contrary, when the rotation speed N decreases below the self operating point S, the power loss L is below the shaft power Wt so that a reverse load is required (See A2 in FIG. 4). As a result, the auxiliary driving motor is reduced in speed.

There is known a conventional vuilleumier heat pump device in which the crank shaft as above-mentioned is connected to a motor and a brake, as disclosed in Japanese Patent Application Laying Open Gazette No. 2-4174. In this prior art, a required rotation speed of the crank shaft which corresponds to a required load is calculated, e.g., during a cooling operation, there is calculated a required rotation speed of the crank shaft which corresponds to a required heat flow in the cooler on the cold side passage. Then, cooling capability is controlled in such a manner that when the required rotation speed exceeds the rotation speed at the self operating point S, the motor is driven, and that when the required rotation speed is lower than the rotation speed at the self operating point S, the brake is operated.

Further, there is known another conventional vuilleumier heat pump device in which the crank shaft as above-mentioned is connected to a brake, as disclosed in Japanese Patent Application Laying Open Gazette No. 4-198671. Also in this prior art, operation capability is controlled in such a manner that when a cooling load or a heating load decreases, the brake is operated to decrease a rotation speed of the crank shaft so that the number of reciprocations of the displacer per unit time is decreased.

In the above prior arts, however, the self operating point S is fixed. Therefore, when the rotation speed N changes, i.e., when the reciprocation speed of the displacer changes so that the rotation speed N increases over the self operating point S, the auxiliary driving motor must be operated, thereby lowering operation efficiency.

On the contrary, when the rotation speed N decreases below the self operating point S, surplus power is generated so that the heat flow to be inputted from the heater increases. Accordingly, an indicated COP (coefficient of performance) (indicated COP=Wc/We, We: a working gas work in a hot space, Wc: a working gas work in a cold space) is lowered and a reverse load is generated, thereby increasing variations of the rotation speed.

In order to adjust the shaft power Wt, there is a method in which the temperature of the hot space is changed by changing the temperature of the heater. In this method, however, an operation with a set efficiency cannot be performed.

In view of the foregoing problems, the present invention has its object of enhancing the COP, reducing variations of the rotation speed and performing an operation with a set efficiency.

DISCLOSURE OF INVENTION

To attain the above object, in the present invention, a volume of a middle-temperature space is varied.

In detail, as shown in FIG. 1, a vuilleumier heat pump device according to claim 1 comprises a hot-side heat pump (2) in which: an inner space of a hot side cylinder (21) is defined into a hot space (24) and a middle-temperature space (25) by a hot side displacer (22); and the hot space (24) and the middle-temperature space (25) are communicated with each other through a hot side passage (5). Further, the vuilleumier heat pump device comprises a cold-side heat pump (3) in which: an inner space of a cold side cylinder (31) is defined into a cold space (34) and a middle-temperature space (35) by a cold side displacer (32); the middle-temperature space (35) is communicated with the middle-temperature space (25) of the hot-side heat pump (2); and the middle-temperature space (35) and the cold space (34) are communicated with each other through a cold side passage (6).

Furthermore, in the vuilleumier heat pump device, there is provided: respective rods (23, 33) connected to the respective displacers (22, 32) of the hot-side heat pump (2) and the cold-side heat pump (3) and extending to the outsides of the respective cylinders (21, 31) with passing through the respective middle-temperature spaces (25, 35); and connection means (4) for connecting both the rods (23, 33) so that both the displacers (22, 32) are reciprocated at a set phase angle.

In addition, there is provided volume adjusting means (8*a*) for changing a volume of at least one of the middle-temperature spaces (35) in the hot-side heat pump (2) and the cold-side heat pump (3).

Further, there is also provided volume control means (9*a*) for detecting a driving speed of the displacers (22, 32) and outputting, to the volume adjusting means (8*a*), a control signal for changing the volume of the middle-temperature space (35) in accordance with the driving speed.

A vuilleumier heat pump device of claim 2 premises the vuilleumier heat pump device according to claim 1 and is so composed that the volume adjusting means (8*a*) is rod volume adjusting means for changing a volume of the rod (33) in at least one of the middle-temperature spaces (35).

A vuilleumier heat pump device of claim 3 premises the vuilleumier heat pump device according to claim 2 and is so composed that the volume adjusting means (8*a*) has: a adjusting motor (82) of which the rotation speed is variable in such a manner as to be controlled by the volume control means (9*a*); a rod cover (81) which is lager in diameter than the rod (33), is passed therethrough via a screw mechanism (84) by the rod (33) and enters and leaves the middle-temperature space (35) by relative rotation with respect to the rod (33) to change the volume of the rod; and a rotation mechanism (83) connected to the adjusting motor (82), is engaged with the rod cover (81) and rotates the rod cover (81) by driving of the adjusting motor (82).

A vuilleumier heat pump device of claim 4 premises the vuilleumier heat pump device according to claims 2 or 8 and is so composed that the volume control means (9*a*) is rod volume control means for calculating the volume of the rod in the middle-temperature space (35) in accordance with the driving speed of the displacers (22, 32) and outputting a control signal to the volume adjusting means (8*a*) so as to match the volume of the rod in the middle-temperature space (35) with the calculated volume of the rod.

A vuilleumier heat pump device of claim 5 premises the vuilleumier heat pump device according to claims 2 or 3 and is so composed that the volume control means (9*b*) is rod volume control means for outputting, to the volume adjusting means (8*a*), a control signal for changing the volume of the rod in the middle-temperature space (35) so that the driving speed of the displacers (22, 32) is a set speed previously set.

A vuilleumier heat pump device of claim 6 premises the vuilleumier heat pump device according to any one of claims 1 to 5 and is so composed that the volume adjusting means (8*a*) changes the volume of the middle-temperature space (35) in the cold-side heat pump device (3).

Under the above construction, the vuilleumier heat pump device of the present invention operates as follows.

First, in the hot-side heat pump (2), a working gas in the hot space (24) is isothermally expanded by heat input on the way of the hot side passage (5), and then is equivalently cooled by providing the heat to the hot side regenerator (7). Next, the working gas is isothermally compressed by heat radiation on the way of the hot side passage (5), and then is equivalently heated by the heat provided to the hot side regenerator (7). On the other hand, in the cold-side heat pump (3), a working gas in the middle-temperature space (35) is equivalently cooled by providing the heat to the cold side regenerator (7) on the way of the cold side passage (6), and then is isothermally expanded by heat input. Next, the working gas is equivalently heated by the heat provided to the cold side regenerator (7) and then is isothermally compressed by heat radiation on the way of the cold side passage (6).

According to the vuilleumier heat pump device of claim 1, the volume control means (9*a*) detects the driving speed of the displacers (22, 32), and then according to the driving speed, outputs, to the volume adjusting means (8*a*), a control signal for changing the volume of the middle-temperature space (35). The volume adjusting means (8*a*) changes the volume of the middle-temperature space (35) based on the control signal outputted.

Specifically, according to the vuilleumier heat pump device of claims 2 or 3, the adjusting motor (82) is controlled in its rotation speed by the volume control means (9*a*). By the controlled rotation of the adjusting motor (82), the rod cover (81) rotates with respect to the rod (33) via the rotation mechanism (83), so that the amount that the rod cover (81) enters or leaves the middle-temperature space (35) changes, thereby changing the volume of the rod in the middle-temperature space (35).

According to the vuilleumier heat pump device of claim 4, the volume control means (9*a*) detects the driving speed of the displacers (22, 32) and then calculates the volume of the rod according to the driving speed. Thereafter, the volume control means (9*a*) outputs a control signal to the volume adjusting means (8*a*) in order that the volume of the rod in the middle-temperature space (35) is matched with the calculated volume of the rod. The volume adjusting means (8*a*) changes the volume of the rod (33) in at least one of the middle-temperature spaces (35), based on the control signal from the volume control means (9*a*). For example, according to the vuilleumier heat pump device of claim 6, the volume adjusting means (8*a*) changes the volume which the rod (33) connected to the cold side displacer (32) occupies in the middle-temperature space (35).

In detail, for example, when the driving speed of the displacer (32) increases, the volume adjusting means (8*a*) increases the amount that the rod cover (81) projects into the middle-temperature space (35) so that the self operating point S is moved upward with respect to the driving speed of the displacer (32). When the driving speed of the displacer (32) decreases, the volume adjusting means (8*a*) deceases the amount that the rod cover (81) projects into the middle-temperature space (35) so that the self operating point S is moved downward with respect to the driving speed of the displacer (32).

According to the vuilleumier heat pump device of claim 5, the volume control means (9b) detects the driving speed of the displacers (22, 32), and then outputs, to the volume adjusting means (8*a*), a control signal for changing the volume of the rod in the middle-temperature space (35) in order that the driving speed is a set speed previously set. For example, according to the vuilleumier heat pump device of claim 6, the volume adjusting means (8*a*) changes the volume which the rod (33) connected to the cold side displacer (32) occupies in the middle-temperature space (35).

In detail, for example, when the driving speed of the displacer (32) increases over the set speed, the volume adjusting means (8*a*) decreases the amount that the rod cover (81) projects into the middle-temperature space (35) so that the self operating point S is moved downward with respect to the driving speed of the displacer (32) to decrease the driving speed. When the driving speed of the displacer (32) decreases below the set speed, the volume adjusting means (8*a*) increases the amount that the rod cover (81) projects into the middle-temperature space (35) so that the self operating point S is moved upward with respect to the driving speed of the displacer (32) to increase the driving speed.

Accordingly, the vuilleumier heat pump device of the present invention performs the following effects.

First, according to the vuilleumier heat pump devices of claims 1 and 4, since the volume of at least one of the middle-temperature spaces (35) is changed, the self operating point S can be changed according to the driving speed. This allows a high efficient operation in a state of high-speed driving operation, without operating auxiliary driving power.

Further, since the self operating point S can be changed according to the decrease of the driving speed, it is not necessary to operate surplus power, that is, a reverse load in a state of low-speed driving operation. This prevents the increase of heat flow inputted from the heater (52), thereby enhancing the indicated COP and enhancing the net COP. In addition, since only the shaft power required to normally operate the displacers can be generated, variations of the driving speed can be reduced.

Furthermore, since the self operating point S can be adjusted, it is not necessary to change the temperature of the hot space (24). This allows an operation with a set efficiency.

According to the vuilleumier heat pump device of claim 2, the volume of the rod of at least one of the displacers (32) is changed, so that the volume of the middle-temperature space (35) can be changed with high precision. This allows a high reliable control to operation capability.

According to the vuilleumier heat pump device of claim 3, since the volume of the rod is changed in such a manner that the rod cover (35) is entered and left with respect to the middle-temperature space (35), the volume of the rod can be adjusted with precision by such a simple structure.

According to the vuilleumier heat pump device of claim 5, since the self operating point S can be adjusted in such a manner that the volume of at least one of the middle-temperature spaces (35) is changed, the driving speed of the displacers (22, 32) can be matched with the set speed without operating auxiliary driving power and surplus power.

According to the vuilleumier heat pump device of claim 6, since the volume of the middle-temperature space (35) in the cold-side heat pump (3) is changed, the self operating point S can be securely adjusted as compared with the case that the volume of the middle-temperature space (25) in the hot-side heat pump (2) is changed. This presents a high reliable control to operation capability.

BRIEF DESCRIPTION OF DRAWINGS

FIG. 8 is a graph showing a characteristic of the shaft power with respect to variations of rod diameter.

BEST MODE FOR CARRYING OUT THE INVENTION

Detailed description is made below about embodiments of the present invention with reference to the drawings.

Figure 1:
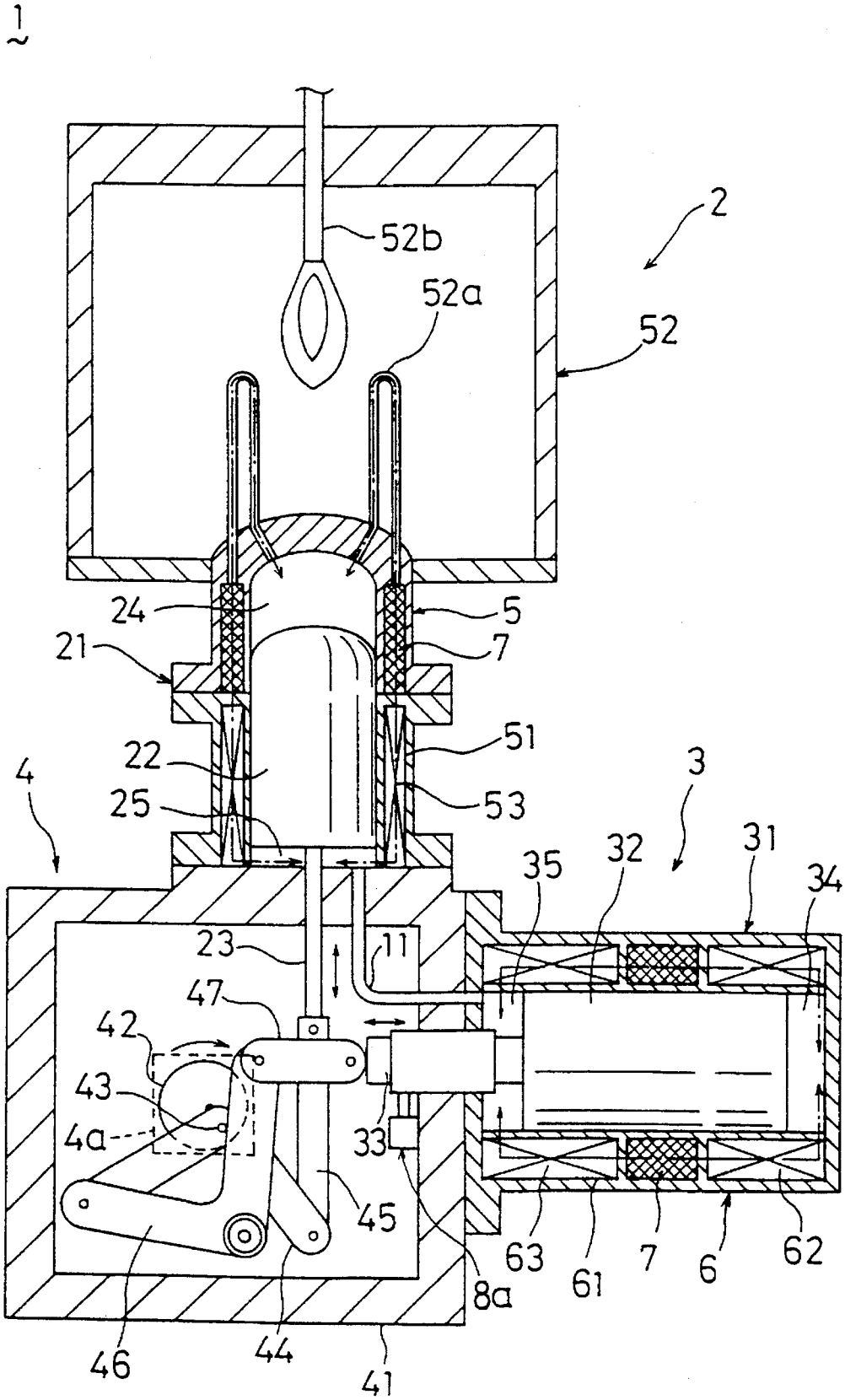
FIG. 1 is a vertical section of a vuilleumier heat pump device.

As shown in FIG. 1, a vuilleumier heat pump device (1) has a hot-side heat pump (2) and a cold-side heat pump (3). Both the heat pumps (2, 3) are disposed so as to intersect at an intersection angle of 90°, and is so composed that respective displacers (22, 32) are inserted in respective cylinders (21, 31) so as to be reciprocally movable. Both the cylinders (21, 31) are integrally jointed to a crank case (41) of a connection mechanism (4) as a connection means to be shut in a sealed condition.

Respective displacers (22, 32) above-mentioned are connected to respective rods (23, 33) extending into the crank case (41). Both the rods (23, 33) are connected to the connection mechanism (4). The connection mechanism (4) is for reciprocating the rods (23, 33) at a phase angle of, for example, 90° and has a crank shaft (42) with a rotational center in a horizontal direction. The crank shaft (42) is supported by the crank case (41), is provided with a crank pin (43) located within the crank case (41) and is connected at an outer end thereof to an auxiliary driving motor (4*a*). The crank pin (43) is connected to a first bell crank (44). An end of the first bell crank (44) is connected to a base end portion of the hot side rod (23) via a first link (45). The hot side rod (23) passes through the crank case (41) and thereafter is connected at a tip end thereof to the hot side displacer (22). The other end of the first bell crank (44) is connected to a base end portion of the cold side rod (33) via a second bell crank (46) and a second link (47). The cold side rod (33) passes through the crank case (41) and thereafter is connected at a tip end thereof to the cold side displacer (32).

An inner space of the hot side cylinder (21) is defined into a hot space (24) on a head side thereof and a middle-temperature space (25) on a rod side thereof by the hot side displacer (22). An inner space of the cold side cylinder (31) is defined into a cold space (34) on a head side thereof and a middle-temperature space (35) on a rod side thereof by the cold side displacer (32). The middle-temperature space (25) of the hot-side heat pump (2) and the middle-temperature space (35) of the cold-side heat pump (3) are connected to each other through a middle-temperature connection tube (11). The hot space (24), cold space (34) and middle-temperature spaces (25, 35) are filled with an working gas such as helium.

The hot space (24) and the middle-temperature space (25) in the hot side cylinder (21) are communicated with each other through a hot side passage (5). The cold space (34) and the middle-temperature space (35) in the cold side cylinder (31) are communicated with each other through a cold side passage (6). The hot side passage (5) is composed of: a cylindrical annular space (51) formed in the interior of a peripheral wall of the hot side cylinder (21) and communicated with the middle-temperature space (25); and a heater tube (52*a*) of a heater (52) as a heating heat exchanger communicated with the annular space (51) and the hot space (24). The cold side passage (6) is composed of a cylindrical annular space (61) formed in the interior of a peripheral wall of the cold side cylinder (31) and communicated with the cold space (34) and the middle-temperature space (35).

The annular space (51) of tile hot side passage (5) is provided with a hot side regenerator (7) composed of a heat accumulation type heat exchanger, and a shell-and-tube type hot-side middle-temperature heat exchanger (53) located on the middle-temperature space (25) side of the regenerator (7). In the heater (52), a burner (52*b*) for heating a working gas in the heater tube (52*a*) is disposed above the hot side cylinder (21). On the other hand, the cold side passage (6) is provided with a cold side regenerator (7) composed of a heat accumulation type heat exchanger, a shell-and-tube type cooler (62) as a cooling heat exchanger located on the cold space (34) side of the regenerator (7), and a shell-and-tube type cold-side middle-temperature heat exchanger (63) located on the middle-temperature space (35) side of the regenerator (7).

Figure 2:
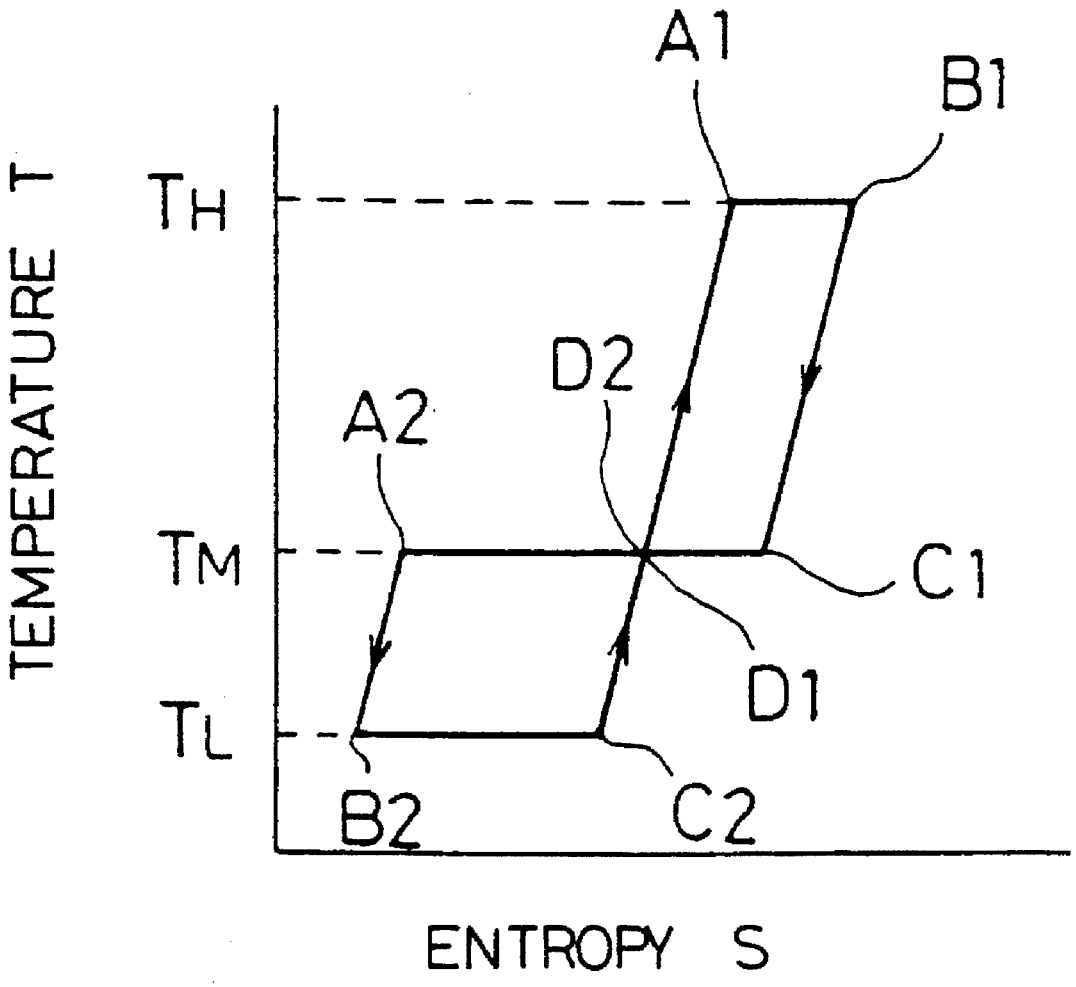
FIG. 2 is a graph showing T-S dependencies of a vuilleumier heat pump cycle.

A heat pump cycle of the vuilleumier heat pump device (1) is shown as in FIG. 2. FIG. 2 shows a relation between the working gas temperature (T) and the entropy (S). As indicated by T-S curves in FIG. 2, the working gas in cycle on the hot side is isothermally expanded by heat input from the heater tube (52*a*) heated by the burner (52*b*) at a process from A1 to B1, and then is equivalently cooled by providing the heat to the hot side regenerator (7) at a process from B1 to C1. Next, the working gas is isothermally compressed by heat radiation through the hot-side middle-temperature heat exchanger (53) at a process from C1 to D1, and then is equivalently heated by the heat provided to the hot side regenerator (7) at a process from D1 to A1.

On the other hand, the working gas in cycle on the cold side is equivalently cooled by providing heat to the cold side regenerator (7) at a process from A2 to B2, and then is iso-thermally expanded by heat input from the cooler (62) at a process B2 to C2. Next, the working gas is equivalently heated by the heat provided to the cold side regenerator (7) at a process from C2 to D2, and then is isothermally compressed by heat radiation through the cold-side middle-temperature heat exchanger (63) at a process from D2 to A2.

Figure 3:
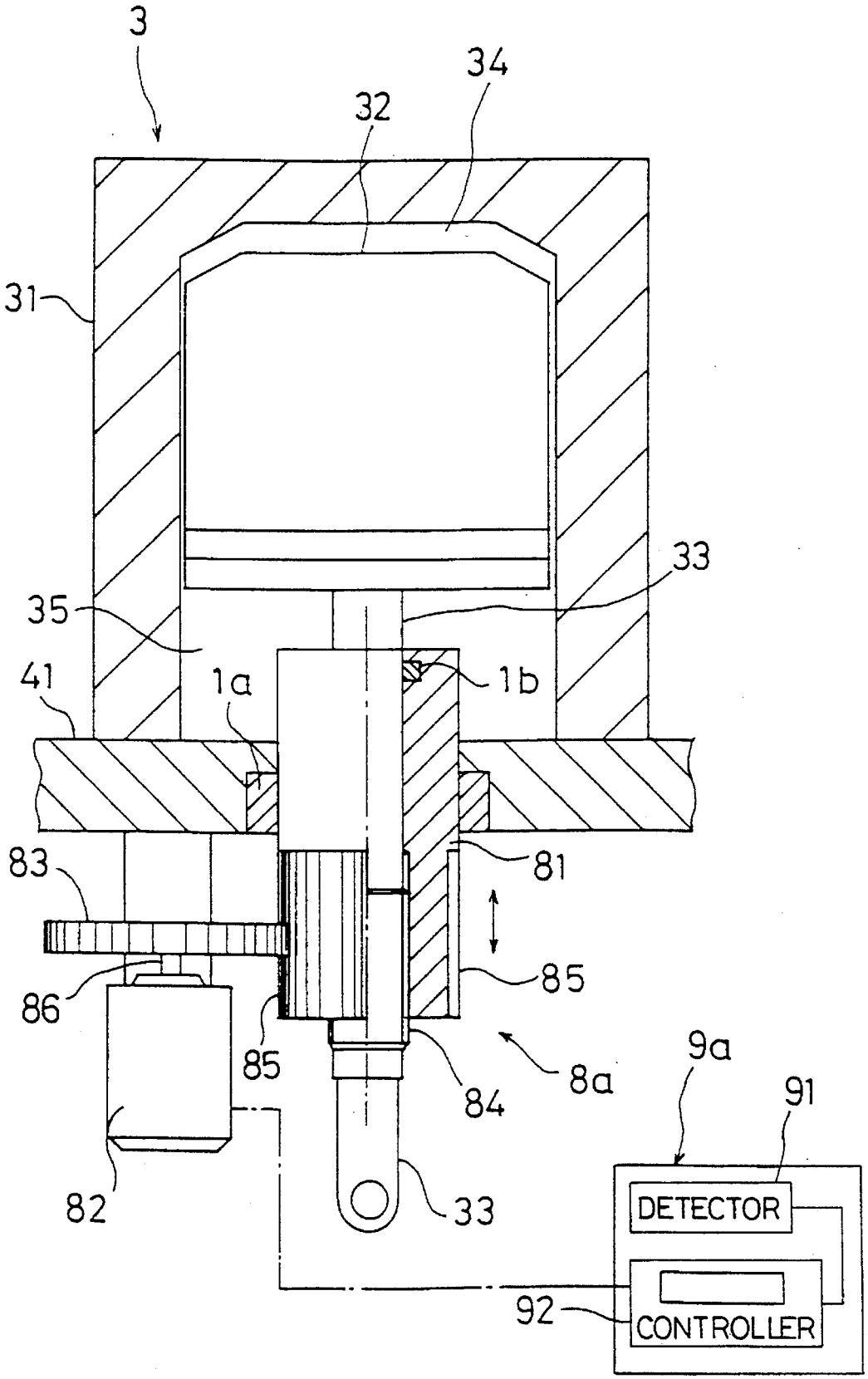

Meanwhile, as a feature of the present invention, as shown in FIG. 3, the rod (33) of the displacer (32) in the cold-side heat pump (3) is provided with a rod volume adjusting means (8*a*) as a volume adjusting means, and the rod volume adjusting means (8*a*) is connected to a rod volume control means (9*a*) as a volume control means.

The rod volume adjusting means (8*a*) is for changing the volume of the rod in the middle-temperature space (35) to change the volume of the middle-temperature space (35), and has a rod cover (81), a adjusting motor (82) and a rotation gear (83). The rod cover (81) is a cylinder formed so as to be larger in diameter than the rod (33). The rod (33) passes through the rod cover (81). A female thread of a screw mechanism (84) is formed on the inner periphery of the rod cover (81), while a male thread of the screw mechanism (84) is formed on the outer periphery of the rod (33). The rod cover (81) passes through the crank case (41) in a sealed condition. An end of the rod cover (81) is located in the middle-temperature space (35) and the other end thereof is located within the crank case (41). The rod cover (81) is composed so as to be capable of entering and leaving the middle-temperature space (35), and has outer teeth (85) formed on the outer periphery thereof on the crank case (41) side.

Reference numerals (1*a*, 1B) indicate seals provided in the crank case (41) and the rod cover (81), respectively.

The adjusting motor (82) is attached to the inside of the crank case (41) and is composed variably in its rotation speed so that the rotation speed is controlled by the rod volume adjusting means (9*a*). A motor shaft (86) of the adjusting motor (82) is connected to the rotation gear (83). The rotation gear (83) is a spur gear to be engaged with the outer teeth (85) of the rod cover (81), thus forming a rotation mechanism for rotating the rod cover (81) by rotation of the adjusting motor (82). The rod cover (81) is composed so as to reciprocate in the axial direction with respect to the rod (33) thereby changing the volume of the rod in the middle-temperature space (35).

The rod volume control means (9*a*) is composed of a rotation speed detector (91) and a controller (92). The rotation speed detector (91) is composed so as to detect a rotation speed N of the crank shaft (42).

The controller (92) is composed so as to calculate a volume of the rod in the middle-temperature space (35) in accordance with the rotation speed N of the crank shaft (42) as a driving speed of the displacers (22, 32), thereby deriving a position of the rod cover (81) with respect to the rod (33), and so as to control the adjusting motor (82) in order that the rod cover (81) reaches the position derived. In detail, when the rotation speed N increases, the rod cover (81) moves upward in FIG. 3 to increase the amount that the rod cover (81) projects into the middle-temperature space (35). On the other hand, when the rotation speed N decreases, the rod cover (81) moves downward to decrease the amount that the rod cover (81) projects into the middle-temperature space (35).

Explanation is made next about the principle that the volume of the rod is changed according to the rotation speed N of the crank shaft (42).

Figure 4:
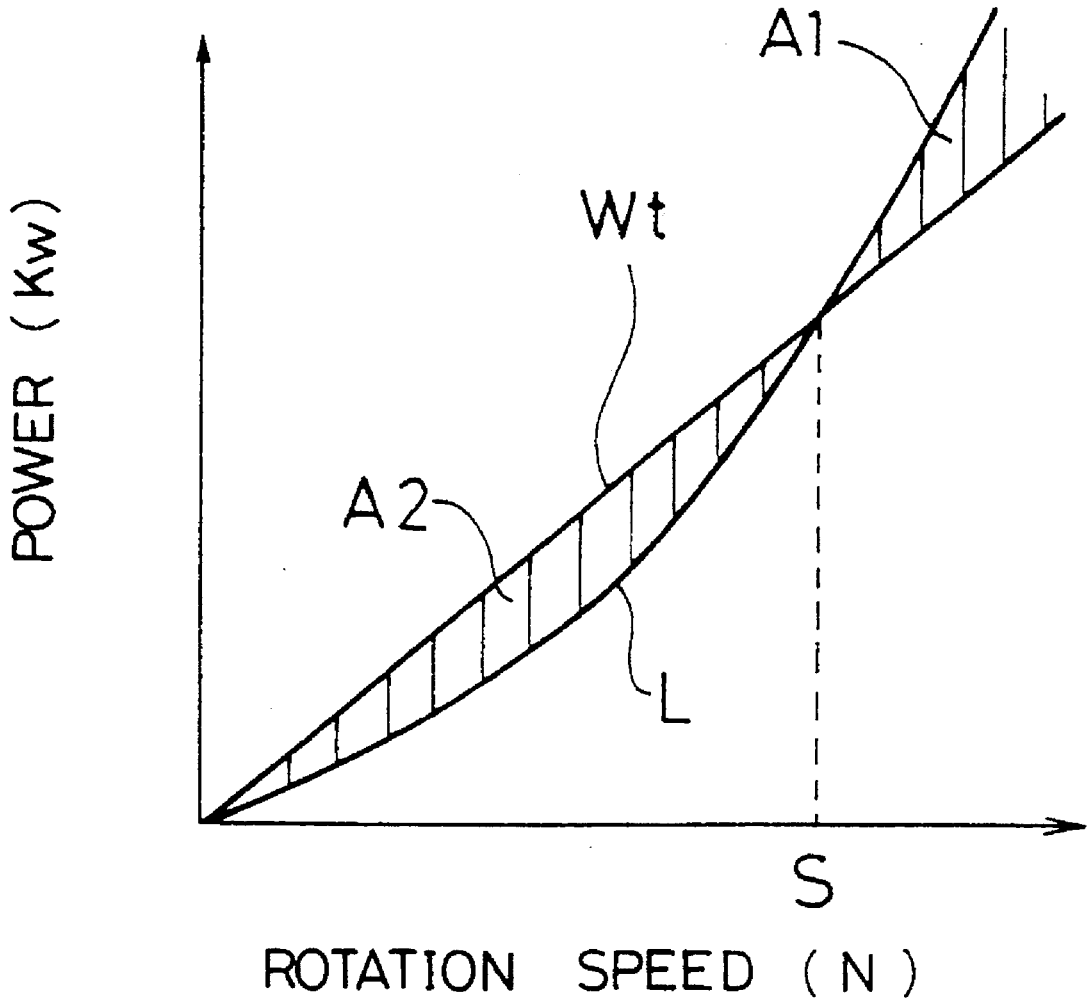
FIG. 4 is a graph showing a characteristic of a shaft power with respect to a rotation speed.

First, as shown in FIG. 4 above-mentioned, the shaft power Wt of the crank shaft (42) increases linearly with respect to the rotation speed N, a power loss L increases in a curved line, and a self operating point S is an intersection point at which variation characteristics of the shaft power Wt and the power loss L intersect.

Observing thermodynamic relations, relations between the shaft power Wt and respective working gas works in the hot space (24), middle-temperature spaces (25, 35) and cold space (34) are shown in the following formulas:

$$Wt=We-Wmh-Wml+Wc \ldots \quad (1);$$

$$We=Wmh+Wl-Wp \ldots \quad (2);$$

$$We=Wml+Wl-Wp \ldots \quad (3); \text{ and}$$

$$P=Wt\times F \ldots \quad (4),$$

wherein Wt is a shaft power, We is a working gas work in the hot space (24), We is a working gas work in the cold space (34), Wmh is a working gas work in the hot-side middle-temperature space (25), Wml is a working gas work in the cold-side middle-temperature space (35), Wl is a work corresponding to a variation of a volume of the rod, Wp is a pressure loss work, P is power (working ratio) of the crank shaft (42), and F is a frequency (N/s).

The working gas work Wml in the cold-side middle-temperature space (35) is shown in the following formula:

$$Wml=\int_0^{2\pi} Pml\cdot dVml, \quad (5)$$

wherein Pml is a pressure of a working gas in the cold-side middle-temperature space (35) and dVml is a slight volume of the cold-side middle-temperature space (35).

Figure 5:
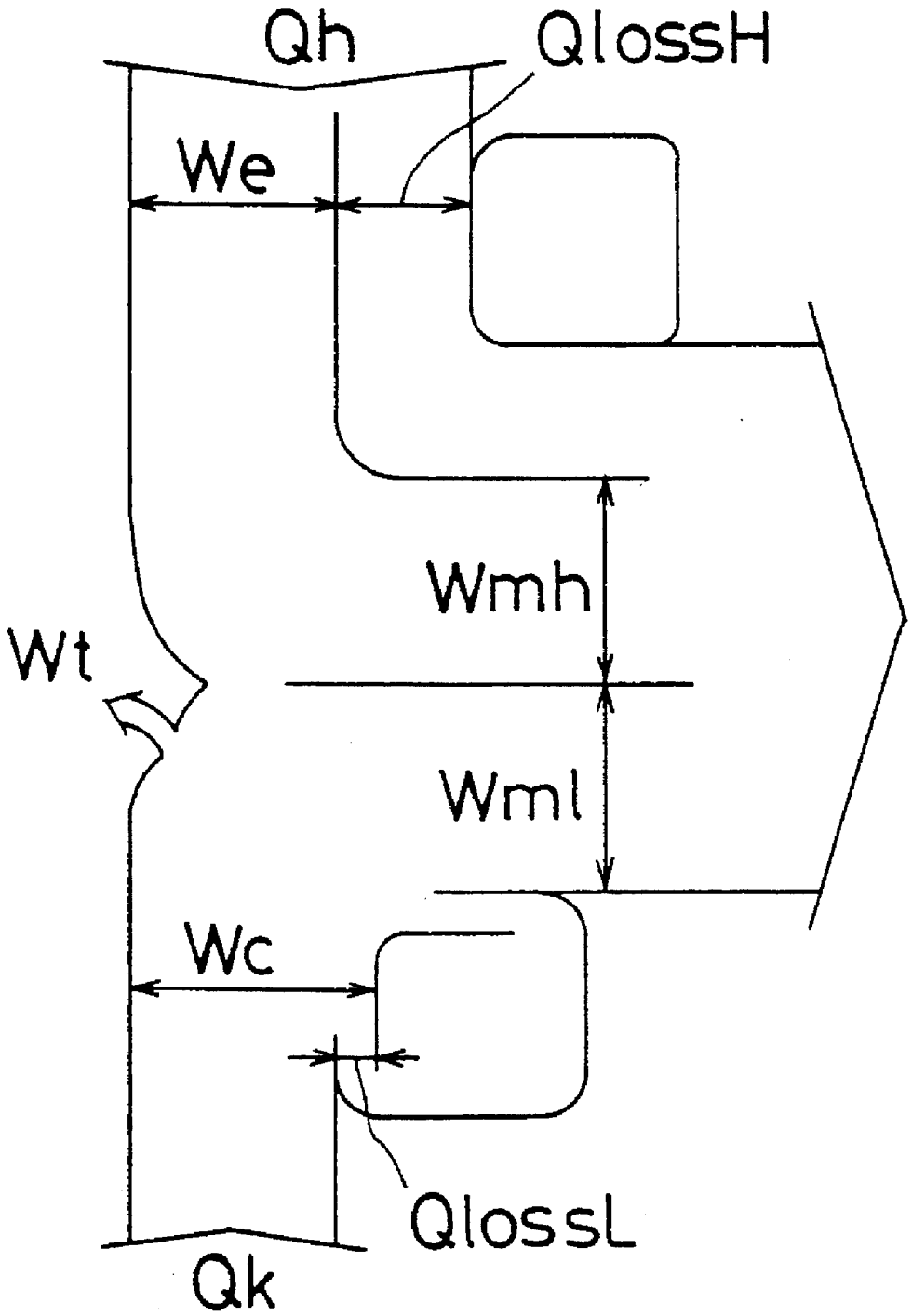
FIG. 5 is a diagram illustrating a relation between the shaft power and a working gas work.
Figure 6:
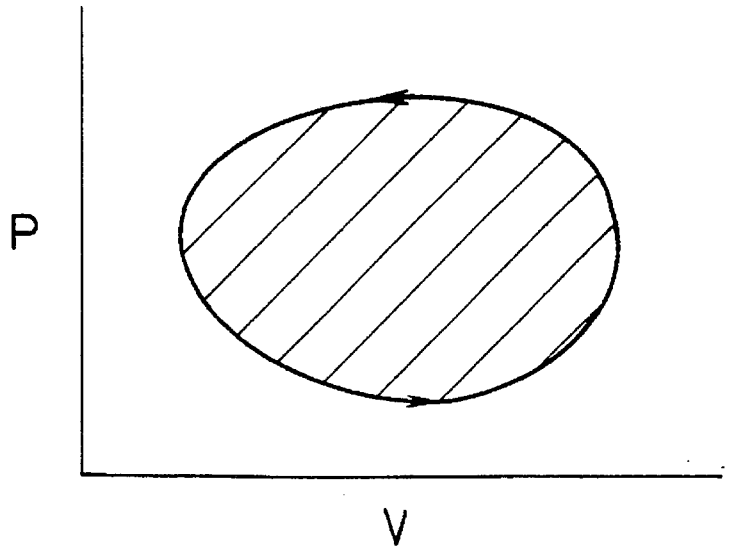
FIG. 6 is a graph showing P-V dependencies of a cold-side middle-temperature space in a prior art.

That is, as shown in FIG. 5, the difference between the sum of the working gas works We, Wc in the hot space (24) and the cold space (34) and the sum of the working gas works Wmh, Wml in the middle-temperature spaces (25, 35) is the shaft power Wt of the crank shaft (42). As is evident from the above formula (5), the working gas work Wml in the cold-side middle-temperature space (35) corresponds to the diagonally shaped area in a thermodynamic cycle of the cold-side middle-temperature space (35) in FIG. 6.

Figure 7:
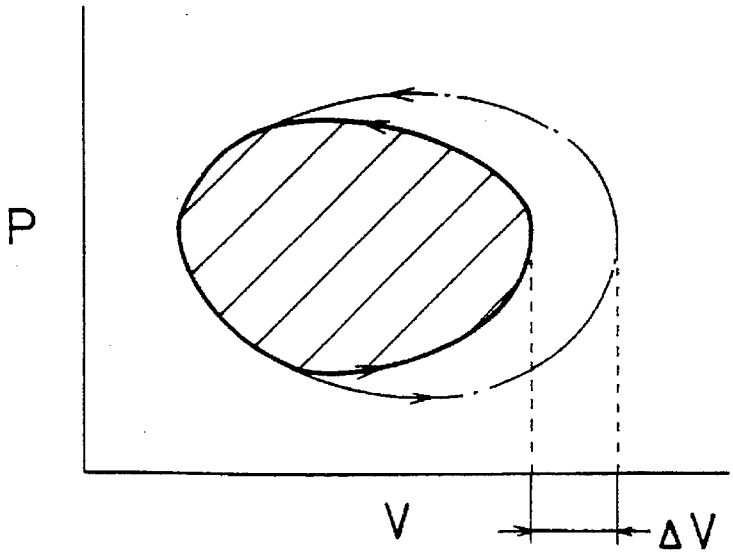
FIG. 7 is a graph showing P-V dependencies of a cold-side middle-temperature space in the present invention.

Accordingly, the working gas work Wml in the cold-side middle-temperature space (35) changes when the volume of the rod is changed. For example, as shown in FIG. 7, when the volume of the cold-side middle-temperature space (35) decreases by ΔV, the working gas work Wml decreases.

As is evident from the thermodynamic relation described above, when the volume of the rod is changed, the shaft power Wt is changed.

Figure 8:
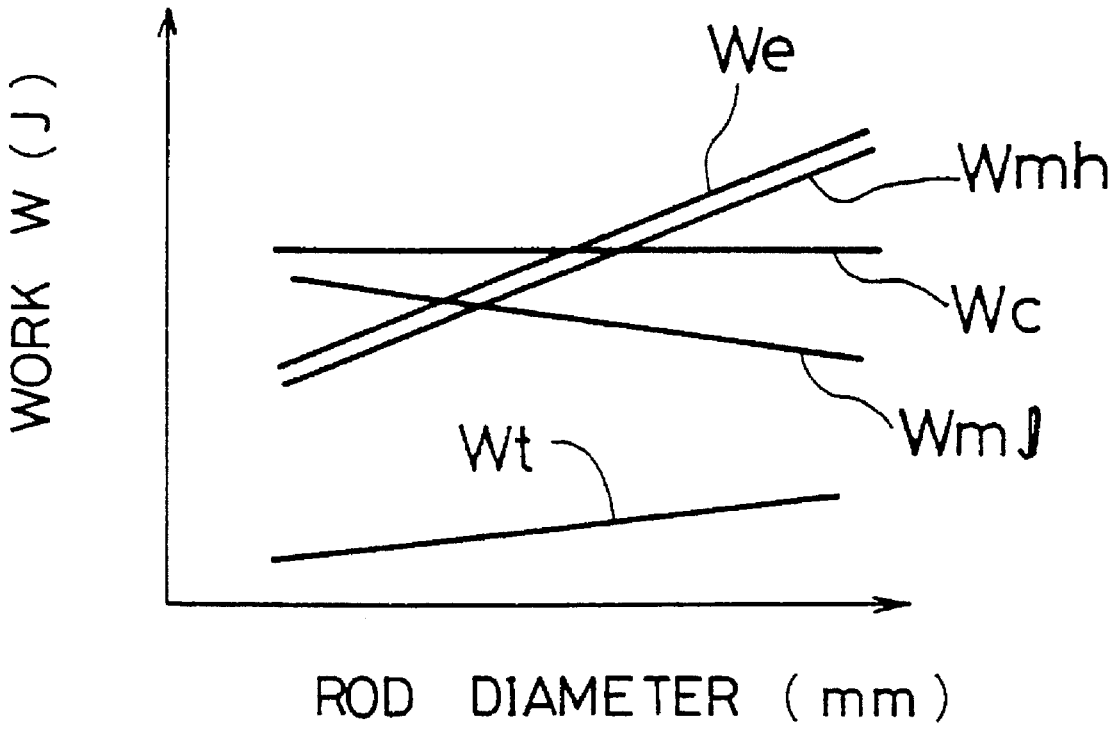
FIG. 8 is a transverse cross section showing a main portion of a cold-side heat pump.

Here, when the rotation speed N of the crank shaft (42) is fixed and the diameter of the cold side rod (33) is changed, respective working gas works above-mentioned are changed as shown in FIG. 8. In FIG. 8, the working gas work We in the hot space (24) and the working gas work Wmh in the hot-side middle-temperature space (25) increase as the diameter of the rod (33) increases, the working gas work Wc in the cold space (34) is approximately uniform, and the working gas work Wml in the cold-side middle-temperature space (35) decreases as the diameter of the rod (33) increases. As a result, the shaft power Wt increases as the diameter of the rod (33) increases.

Meanwhile, when observing dynamical relations, the mechanism in which the shaft power Wt generates is explained below.

Figure 9:
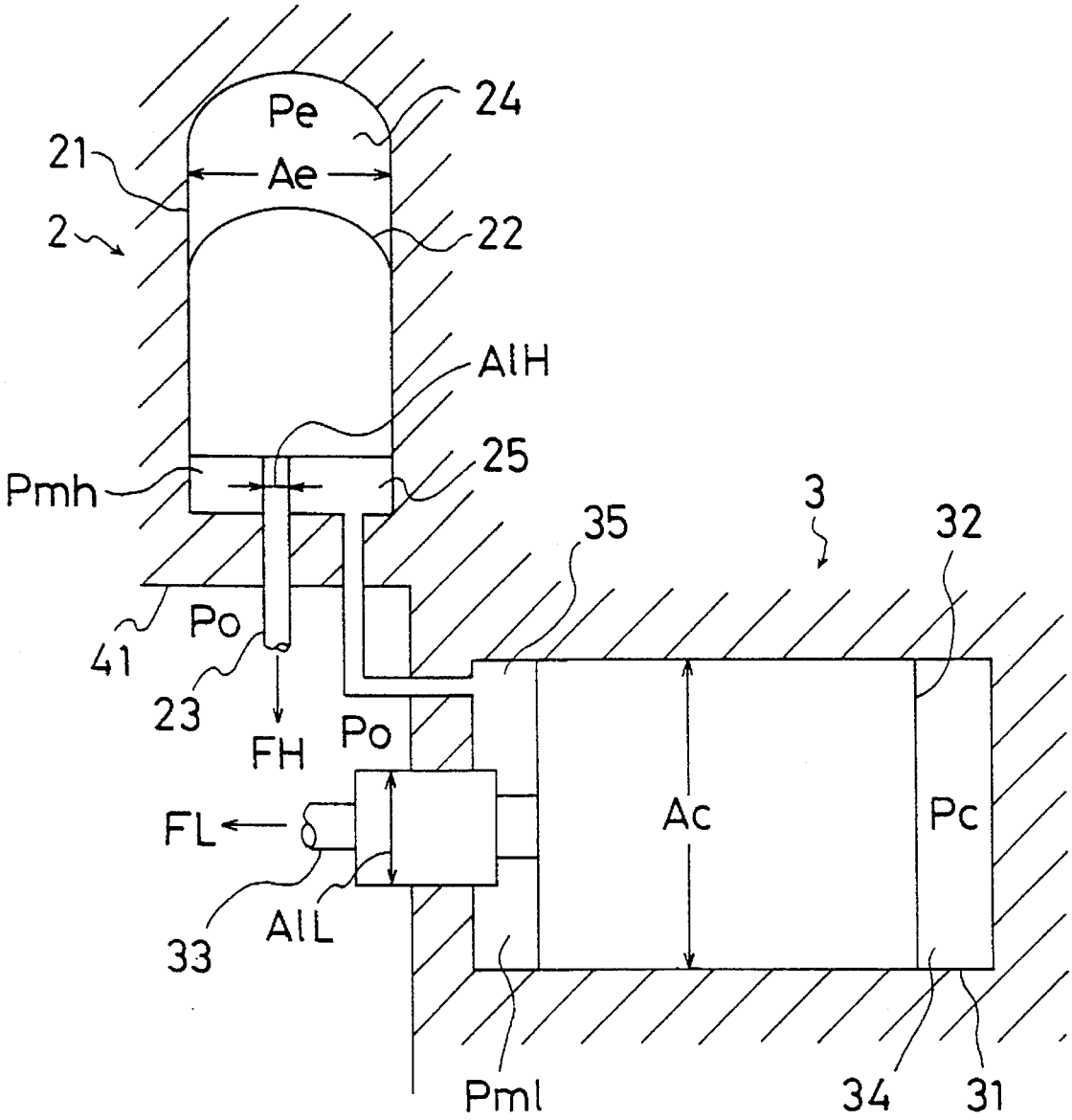
FIG. 9 is a schematic diagram of the vuilleumier heat pump device for illustrating the shaft power.

In the below-mentioned formulas, respective references are indicated in FIG. 9, wherein FH is shaft force of the hot side rod (23), Pe is a pressure of a working gas in the hot space (24), Pmh is a pressure of a working gas in the hot-side middle-temperature space (25), PO is an average pressure of a working gas, that is, a pressure of a working gas at the inside of the crank case (41), Ae is a cross-sectional area of the hot side cylinder (21), AlH is a cross-sectional area of the hot side rod (23), FL is shaft force of the cold side rod (33), Pc is a pressure of a working gas in the cold space (34), Pml is a pressure of a working gas in the cold-side middle-temperature space (35), Ac is a cross-sectional area of the cold side cylinder (31), and AlL is a cross-sectional area of the cold side rod (33).

First, the shaft force FH of the hot side rod (23) is expressed in the following formula:

$$FH=Pe\times Ae-Pmh(Ae-AlH)-PO\times AlH \ldots \quad (6)$$

The shaft force FL of the cold side rod (33) is expressed in the following formula:

$$FL=Pc\times Ac-Pml(Ac-AlL)-PO\times AlL \ldots \quad (7)$$

Figure 10:
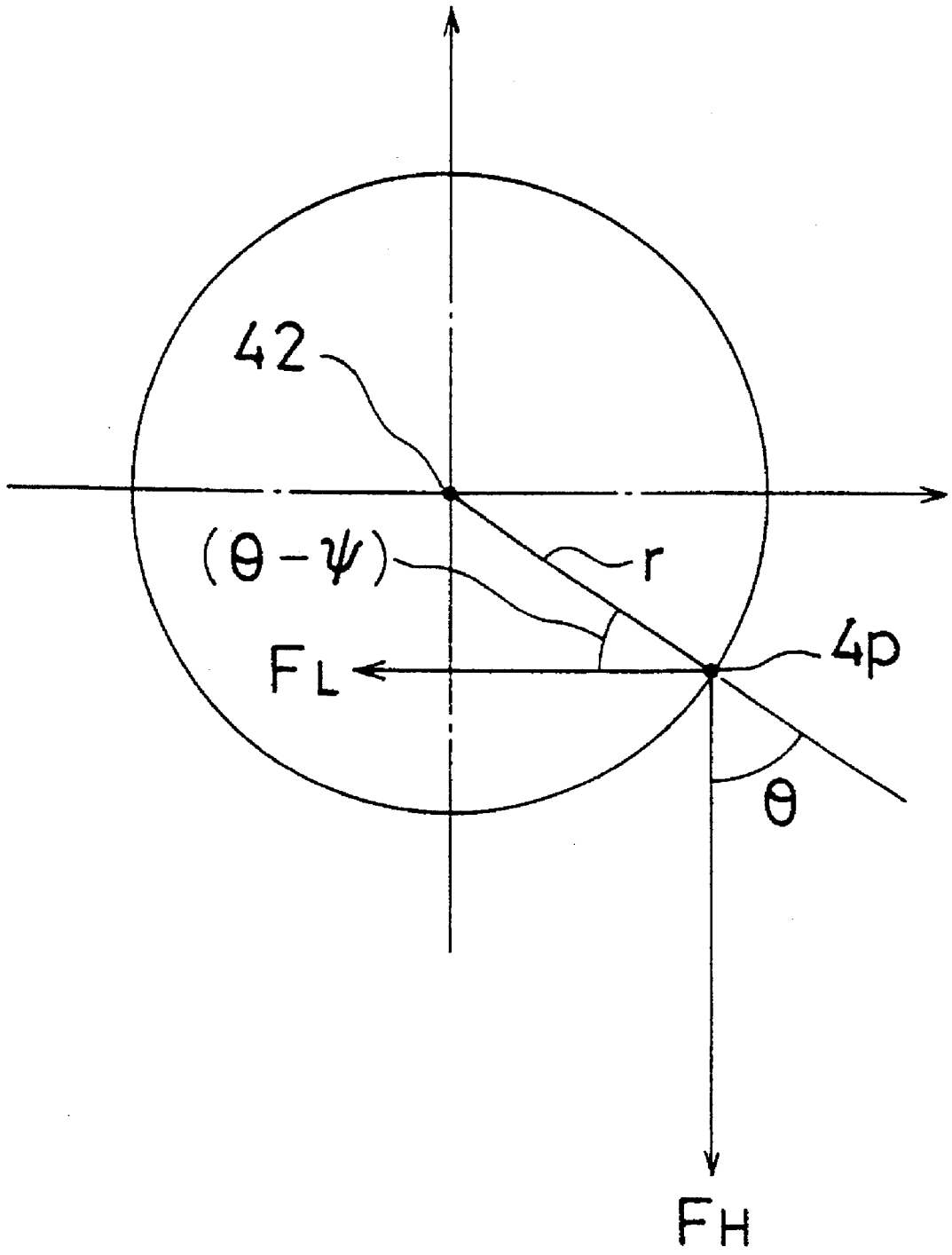
FIG. 10 is a diagram showing an output relation for illustrating shaft torque.

When shaft torque T of the crank shaft (42) is calculated based on both the shaft force FH, FL under the following conditions as shown in FIG. 10: r is a distance between the crank shaft (42) and a connection point (4p) of the rods (23, 33); θ is a rotation angle of the crank shaft (42); and ϕ is a phase angle, the shaft torque T is expressed in the following formula:

$$T=FH\times r\times\sin\theta+FL\times r\times\sin(\theta-\phi) \ldots \quad (8).$$

The shaft power Wt is expressed in the following formula:

$$Wt=\int_0^{2\pi} T\cdot d\theta. \quad (8)$$

As is evident from the dynamical relations shown in the above formulas (6) to (9), when the volume of the rod is changed, that is, when the cross-sectional area AlL of the cold side rod (33) in the formula (7) is changed, the shaft power Wt is changed.

Figure 11:
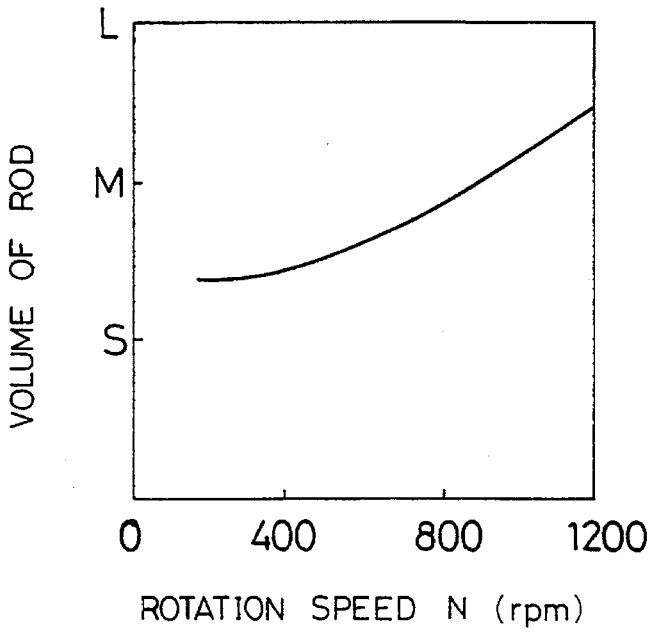
FIG. 11 is a graph showing a characteristic of a volume of a rod with respect to a rotation speed at a self operating point.
Figure 12:
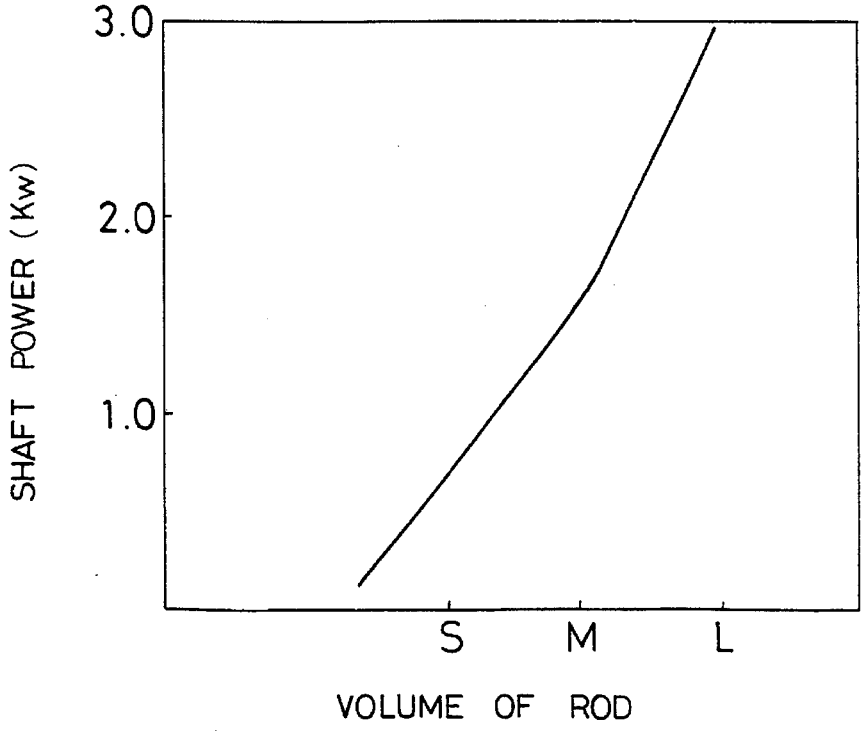
FIG. 12 is a graph showing a characteristic of the shaft power with respect to the volume of the rod.

FIGS. 11 and 12 show detailed variation characteristics of the self operating point S and the shaft power Wt in the case that the volume of the cold side rod (33) is changed.

As shown in FIG. 11, the rotation speed of the self operating point S increases as the volume of the cold side rod (33) increases. In other words, the gradient of variation characteristic line of the shaft power Wt shown in FIG. 4 increases as the volume of the cold side rod (33) increases.

As shown in FIG. 12, the shaft power Wt increases as the volume of the cold side rod (33) increases.

As described above, in the present embodiment, the volume of the cold side rod (33) is changed according to the rotation speed N of the crank shaft (42) so that, as shown in FIG. 4, the shaft power Wt is changed, thereby changing the self operating point S along the curve of the power loss L.

Figure 13:
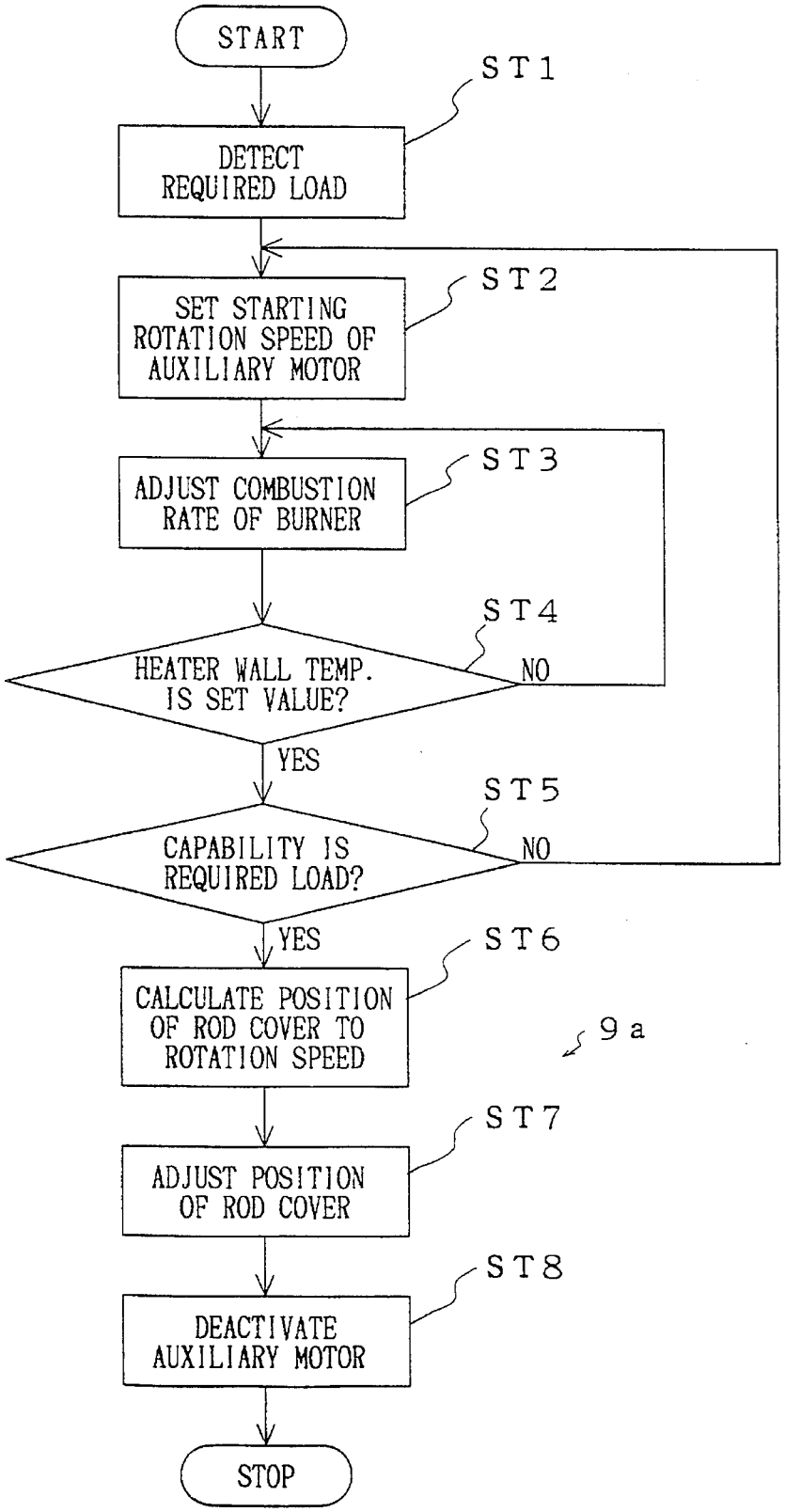
FIG. 13 is a control flow chart for controlling the volume of the rod.

Description is made below about the operation for changing the volume of the cold side rod (33), with reference to a control flow chart shown in FIG. 13.

First, at a step ST1 after process starts, a required load is detected. Then, the routine proceeds to a step ST2 and at the step a starting rotation speed of the auxiliary driving motor (4*a*) is set based on the required load. Next, the routine proceeds to a step ST3 and at the step a combustion rate of the burner (52*b*) is adjusted. The routine proceeds to a step ST4 and at the step there is judged whether a wall temperature of the heater (52) is a set value. Until the wall temperature reaches to the set value, the routine returns to the step ST3 and the combustion rate of the burner (52*b*) is adjusted.

Then, when the wall temperature of the heater (52) reaches to the set value, the judgment at the step ST4 is YES and the routine proceeds to a step ST5. At the step ST5, judged is whether the capability is the required load. Until the capability reaches the required load, the routine returns to the step ST2 and the auxiliary driving motor (4*a*) and the heater (52) are adjusted.

On the other hand, when the capability reaches the required load, the routine proceeds from the step ST5 to the step ST6. At the step ST6, the position of the rod cover (81) is calculated by the rod volume control means (9*a*). In detail, since the rotation speed detector (91) detects the rotation speed N of the crank shaft (42), the controller (92) calculates the position of the rod cover (81) based on the rotation speed N to output a control signal to the adjusting motor (82).

Then, the routine proceeds from the step ST7 to the step ST8. At the step ST8, the rod volume adjusting means (8*a*) adjusts the position of the rod cover (81) based on the control signal from the controller (92). In detail, the adjusting motor (82) drives based on the control signal and the drive of the adjusting motor (82) rotates the rotation gear (83). The rotation of the rotation gear (83) rotates the rod cover (81) to move the rod cover (81), through the screw mechanism (84), in the axial direction with respect to the rod (33), i.e., in a vertical direction in FIG. 3. The movement of the rod cover (81) changes the amount that the rod cover (81) enters and leaves the middle-temperature space (35) to change the volume of the rod, thereby adjusting the shaft power Wt of the crank shaft (42). Thereafter, the routine proceeds to a step ST8. At the step, the auxiliary driving motor (4*a*) is deactivated so that the control process terminates.

More specifically, when the rotation speed N of the crank shaft (42) increases, the position of the rod cover (81) is moved upward in FIG. 3 so that the amount that the rod cover (81) projects into the middle-temperature space (35) increases, thereby increasing a variation of the volume of the rod. That is, the self operating point S in FIG. 4 is moved upward along the power loss L. On the contrary, when the rotation speed N of the crank shaft (42) decreases, the position of the rod cover (81) is moved downward in FIG. 3 so that the amount that the rod cover (81) projects into the middle-temperature space (35) decreases, thereby decreasing the variation of the volume of the rod. That is, the self operating point S in FIG. 4 is moved downward along the power loss L.

As described above, according to the present embodiment, since the volume of the rod of the cold side displacer (32) is changed, the self operating point S can be changed according to the driving speed. This allows a high efficient operation in a state of high-speed driving operation, without operating auxiliary driving power.

Further, since the self operating point S can be changed according to the decrease of the driving speed, it is not necessary to operate surplus power, that is, a reverse load in a state of low-speed driving operation. This prevents the increase of heat flow inputted from the heater (52), thereby enhancing the indicated COP and enhancing the net COP. In addition, since only the shaft power required to normally operate the displacers can be generated, variations of the driving speed can be reduced.

Furthermore, since the self operating point S can be adjusted, it is not necessary to change the temperature of the hot space (24). This allows an operation with a set efficiency.

The volume of the rod of the cold side displacer (32) is changed, so that the volume of the cold-side middle-temperature space (35) can be changed with high precision. This allows a high reliable control to operation capability.

Since the volume of the rod is changed in such a manner that the rod cover (35) is entered and left with respect to the cold-side middle-temperature space (35), the volume of the rod can be adjusted with precision by such a simple structure.

Since the volume of the middle-temperature space (35) in the cold-side heat pump (3) is changed, the self operating point S can be securely adjusted as compared with the case that the volume of the middle-temperature space (25) in the hot-side heat pump (2) is changed. This presents a high reliable control to operation capability.

Figure 14:
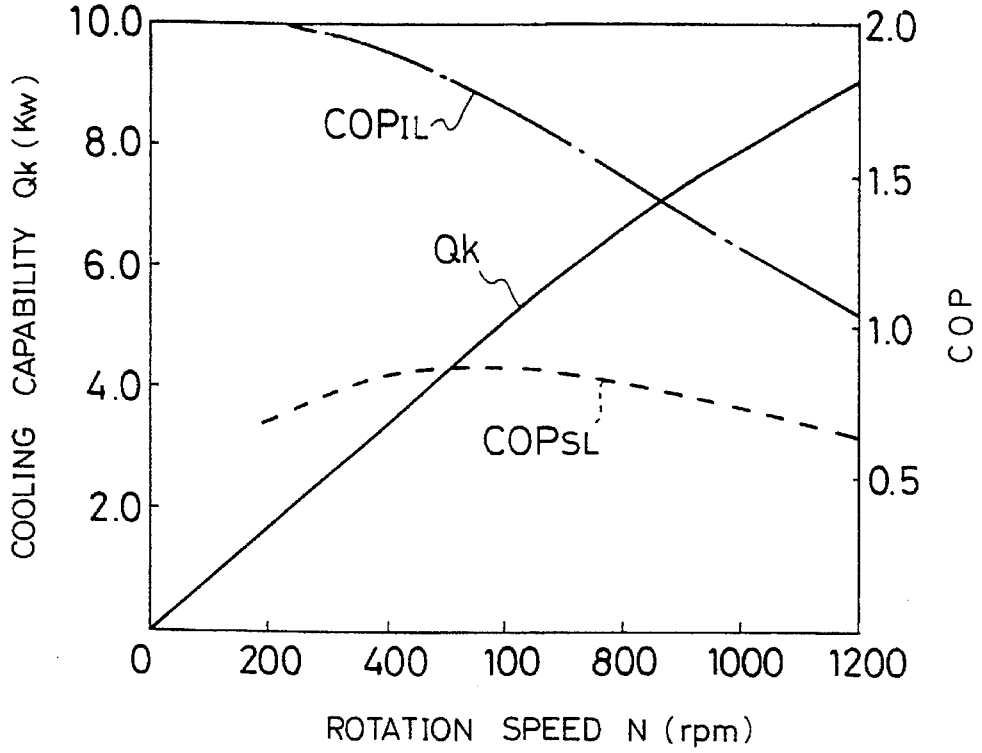
FIG. 14 is a graph showing respective characteristics of cooling capability and a COP with respect to the rotation speed.
Figure 15:
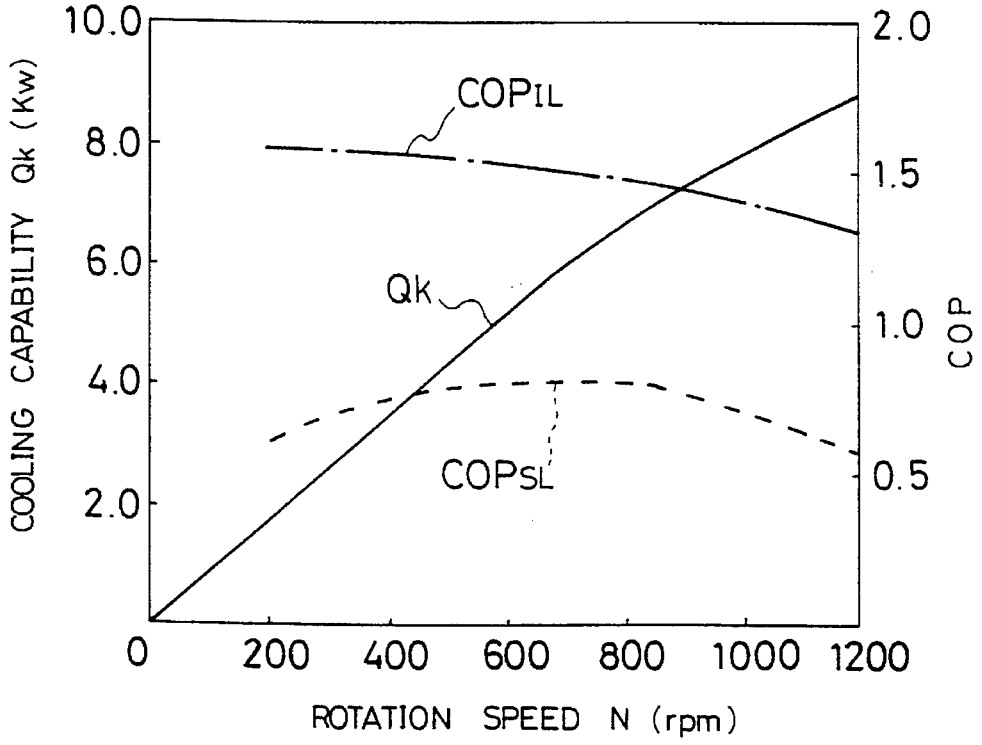
FIG. 15 is a graph showing respective characteristics of cooling capability and a COP with respect to the rotation speed in the prior art.

With regard to both variation characteristics of the indicated COP and the net COP, comparison is made next between the present embodiment and the prior art. FIG. 14 shows variation characteristics of the indicated COP and the net COP in the present embodiment. FIG. 15 shows variation characteristics of the indicated COP and the net COP in the prior art. Both of the indicated COP and the net COP in the present embodiment are improved.

Described in detail are the indicated COP ($COP_{IL}$) and the net COP ($COP_{SL}$). The indicated COP ($COP_{IL}$) is expressed in the following formula:

$$COP_{IL}=Wc/We \ldots \quad (10).$$

The net COP ($COP_{SL}$) is expressed in the following formula:

$$COP_{SL}=Qk/(Qh+PowT/0.33) \ldots \quad (11),$$

wherein Qk is a heat flow in the cold space (34), Qh is a heat flow in the hot space (24) and PowT is auxiliary shaft power required for rotation.

Here, as shown in FIG. 5, the heat flow Qk in the cold space (34) and the heat flow in the hot space (24) are expressed in the following respective formulas:

$$Qk=Wc-QlossL \ldots \quad (12); \text{ and}$$

$$Qh=We-QlossH \ldots \quad (13),$$

wherein Wc is a working gas work in the cold space (34), QlossL is a heat loss in the cold space (34), We is a working gas work in the hot space (24) and the QlossH is a heat loss in the hot space (24). PowT as the auxiliary shaft power required for rotation is expressed in the following formula:

$$PowT=L-Wt \ldots \quad (14),$$

wherein L is a power loss and Wt is a shaft power (See formula (1)).

As shown in FIGS. 14 and 15, as the rotation speed N of the crank shaft (42) increases, the cooling capability Qk (the heat flow in the cold space (35)) increases. As compared with the prior art, the indicated COP in the present embodiment is improved when the rotation speed N is lower than that at the self operating point S, though it is inferior when the rotation speed N is higher than that at the self operating point S. The net COP in the present embodiment is improved all over the range of the rotation speed.

Figure 16:
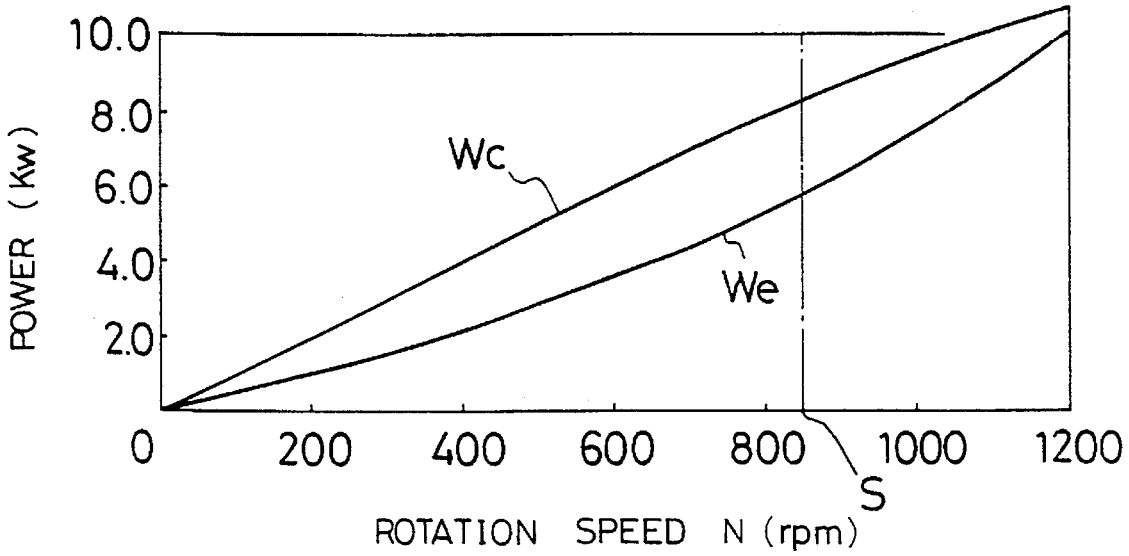
FIG. 16 is a graph showing a characteristic of the shaft power with respect to the rotation speed in the present invention.
Figure 17:
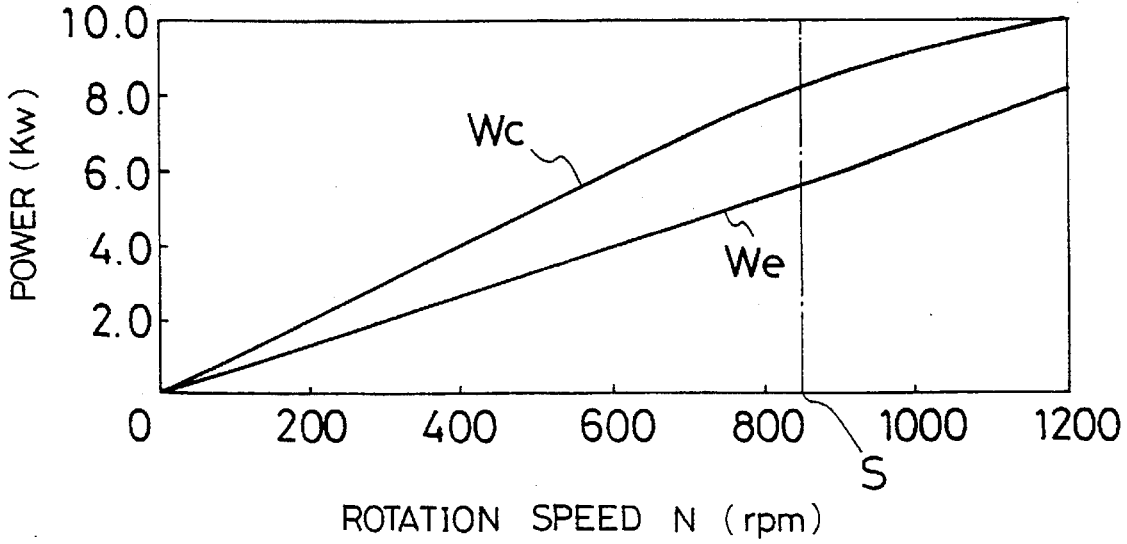
FIG. 17 is a graph showing a characteristic of the shaft power with respect to the rotation speed in the prior art.

FIG. 16 shows both variation characteristics of the working gas work We in the hot space (24) and the working gas work Wc in the cold space (34) with respect to the rotation speed N in the present embodiment (wherein the volume of the rod is variable). FIG. 17 shows both variation characteristics of the working gas work We in the hot space (24) and the working gas work We in the cold space (34) with respect to the rotation speed N in the prior art (wherein the volume of the rod is fixed).

Figure 18:
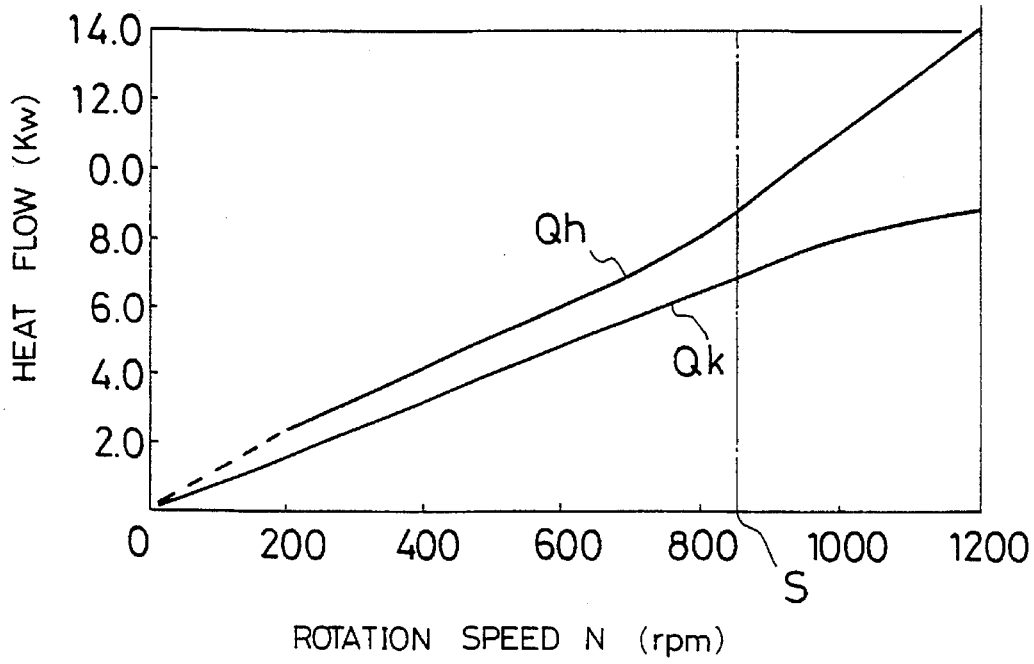
FIG. 18 is a graph showing a characteristic of a heat flow with respect to the rotation speed in the present invention.
Figure 19:
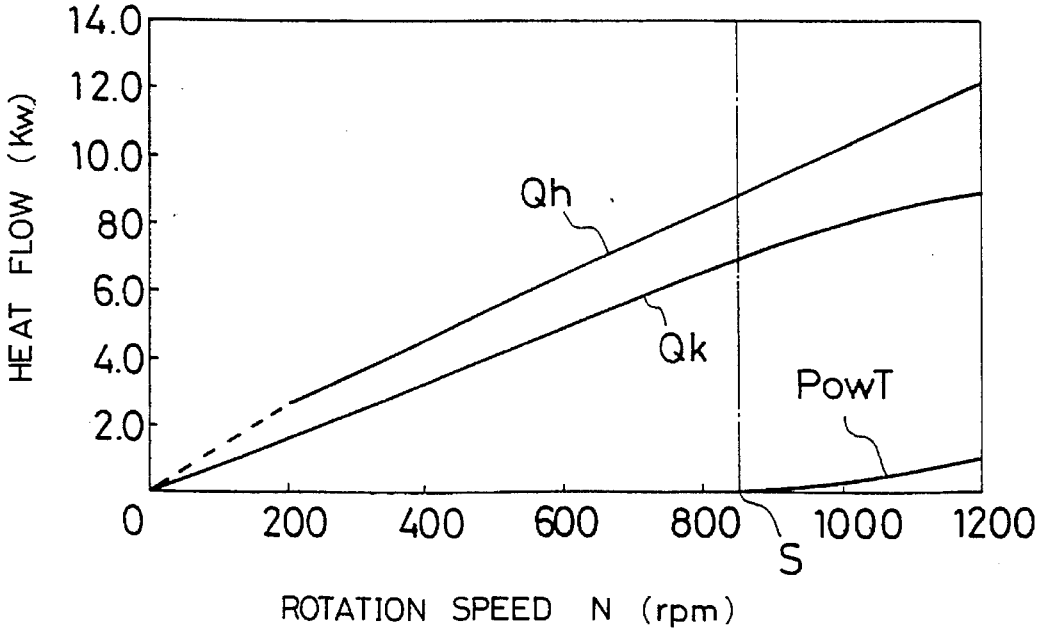
FIG. 19 is a graph showing a characteristic of a heat flow with respect to the rotation speed in the prior art.

FIG. 18 shows both variation characteristics of the heat flow Qh in the hot space (24) and the heat flow Qk in the cold space (34) with respect to the rotation speed N in the present embodiment (wherein the volume of the rod is variable). FIG. 19 shows both variation characteristics of the heat flow Qh in the hot space (24) and the heat flow Qk in the cold space (34) with respect to the rotation speed N in the prior art (wherein the volume of the rod is fixed).

In the conditions that the rotation speed N is lower than at the self operating point S, when the volume of the rod is variable as in the present embodiment, the working gas work We in the hot space (24) is less so that the heat flow Qh in the hot space (24) is less, as compared with the case that the volume of the rod is fixed as in the prior art. Accordingly, as derived from the formulas (10) and (11), both the indicated COP and the net COP are improved in the present embodiment.

On the other hand, in the conditions that the rotation speed N is higher than at the self operating point S, when the volume of the rod is variable as in the present embodiment, the working gas work We in the hot space (24) is larger as compared with the case that the volume of the rod is fixed as in the prior art. Thus, as derived from the formula (10), the indicated COP decreases and the heat flow Qh in the hot space (24) is larger than in the prior art. However, the auxiliary shaft power PowT in the formula (11) is not required. As a result, according to the present embodiment, the net COP is improved.

Figure 20:
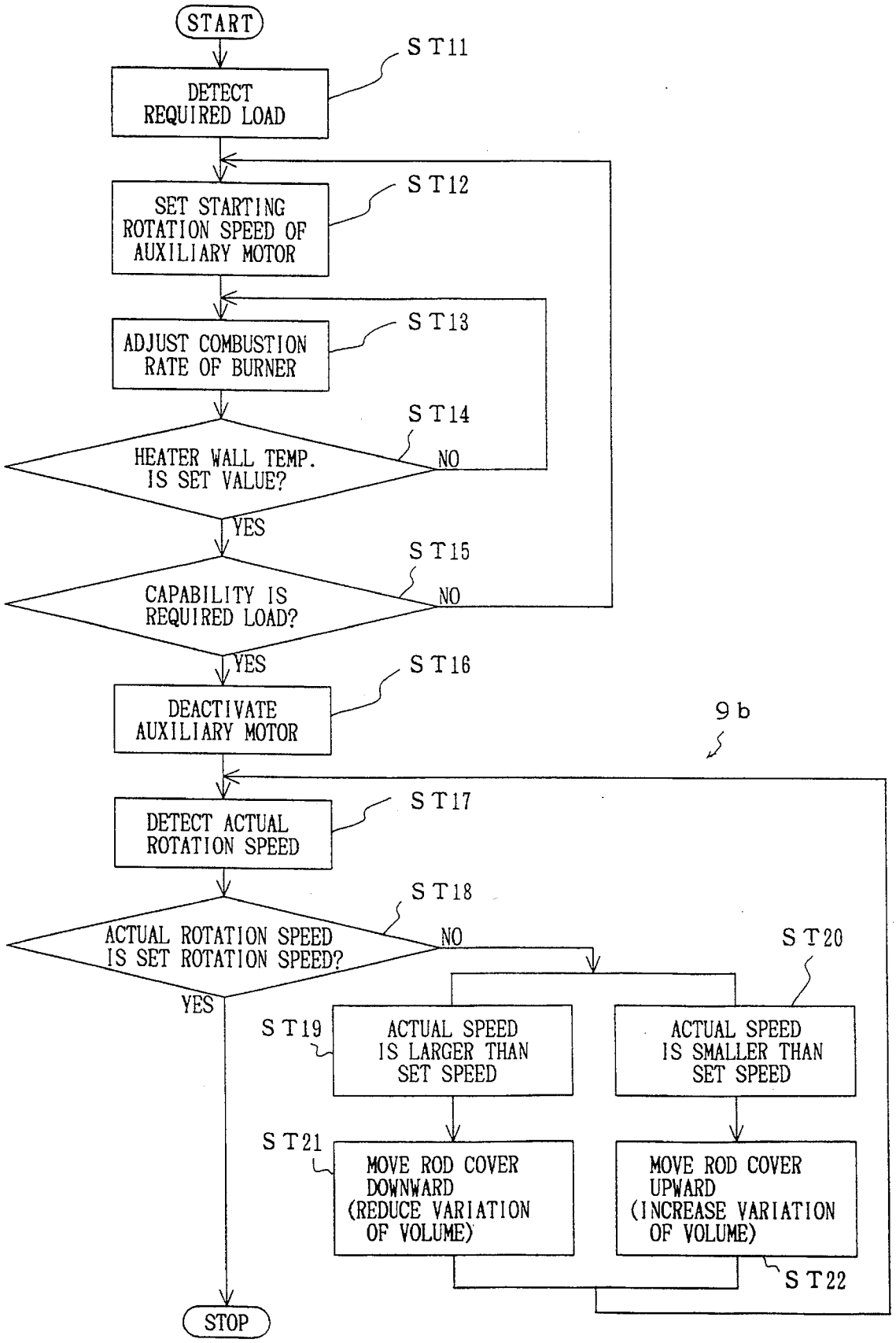
FIG. 20 is a control flow chart for controlling a volume of a rod in another embodiment of the present invention.

FIG. 20 shows a rod volume control means (9*b*) in another embodiment of the present invention. In the rod volume control means (9*b*), the position of the rod cover (81) is adjusted so that the rotation speed N of the crank shaft (42) is controlled in a feedback manner. In other words, the rod volume control means (9*b*) calculates the position of the rod cover (81) in order that the rotation speed N reaches a set rotation speed.

In detail, after process starts, steps ST11 to ST15 operates as is at the steps ST1 to ST5 in the first-mentioned embodiment. That is, after a required load is detected, a starting rotation speed of the auxiliary driving motor (4*a*) is set. Thereafter, a combustion rate of the burner (52*b*) is adjusted based on the wall temperature of the heater (52) and then the auxiliary driving motor (4*a*) is adjusted in order that the capability reaches the required load.

Then, when the capability reaches the required load, the routine proceeds from the step ST15 to a step ST16. At the step, the auxiliary driving motor (4*a*) is deactivated and then the routine proceeds to a step ST17. At the step, an actual rotation speed N of the crank shaft (42) is detected by the rotation speed detector (91). The routine proceeds to a step ST18 and at this step, there is judged whether the actual rotation speed N is the set rotation speed. When the actual rotation speed is the set rotation speed, the process control terminates. On the other hand, when the actual rotation speed is not the set rotation speed, the routine proceeds to steps ST19 or ST20.

In detail, when the actual rotation speed N is larger than the set rotation speed, the routine proceeds to the step ST20 via the step ST19. At the step, the adjusting motor (82) is driven based on the control signal from the controller (92) so that the rod cover (81) is moved downward from the position in FIG. 3. Then, the routine returns to the step ST17. More specifically, when the actual rotation speed N is larger than the set rotation speed, the amount that the rod cover (81) projects into the middle-temperature space (35) is reduced to reduce a variation of the volume of the rod, so that the shaft power Wt is lowered thereby moving the self operating point S downward. As a result, since no auxiliary driving power exists due to the deactivation of the auxiliary driving motor (4*a*), the rotation speed N decreases.

On the contrary, when the actual rotation speed N is smaller than the set rotation speed, the routine proceeds to a step ST21 via the step ST20. At the step, the adjusting motor (82) is driven based on the control signal from the controller (92) so that the rod cover (81) is moved upward from the position in FIG. 3. Then, the routine returns to the step ST17. More specifically, when the actual rotation speed N is smaller than the set rotation speed, the amount that the rod cover (81) projects into the middle-temperature space (35) is increased to increase a variation of the volume of the rod, so that the shaft power Wt is increased thereby moving the self operating point S upward. As a result, since no reverse load operates due to the deactivation of the auxiliary driving motor (4*a*), the rotation speed N increases.

By the movement of the rod cover (81), the actual rotation speed N is matched with the set rotation speed.

As described above, according to the present embodiment, since the self operating point S can be adjusted in such a manner that the volume of the rod in the cold-side middle-temperature space (35) is changed, the driving speed of the displacers (22, 32) can be matched with the set speed without operating auxiliary driving power and surplus power as in the prior art.

Figure 21:
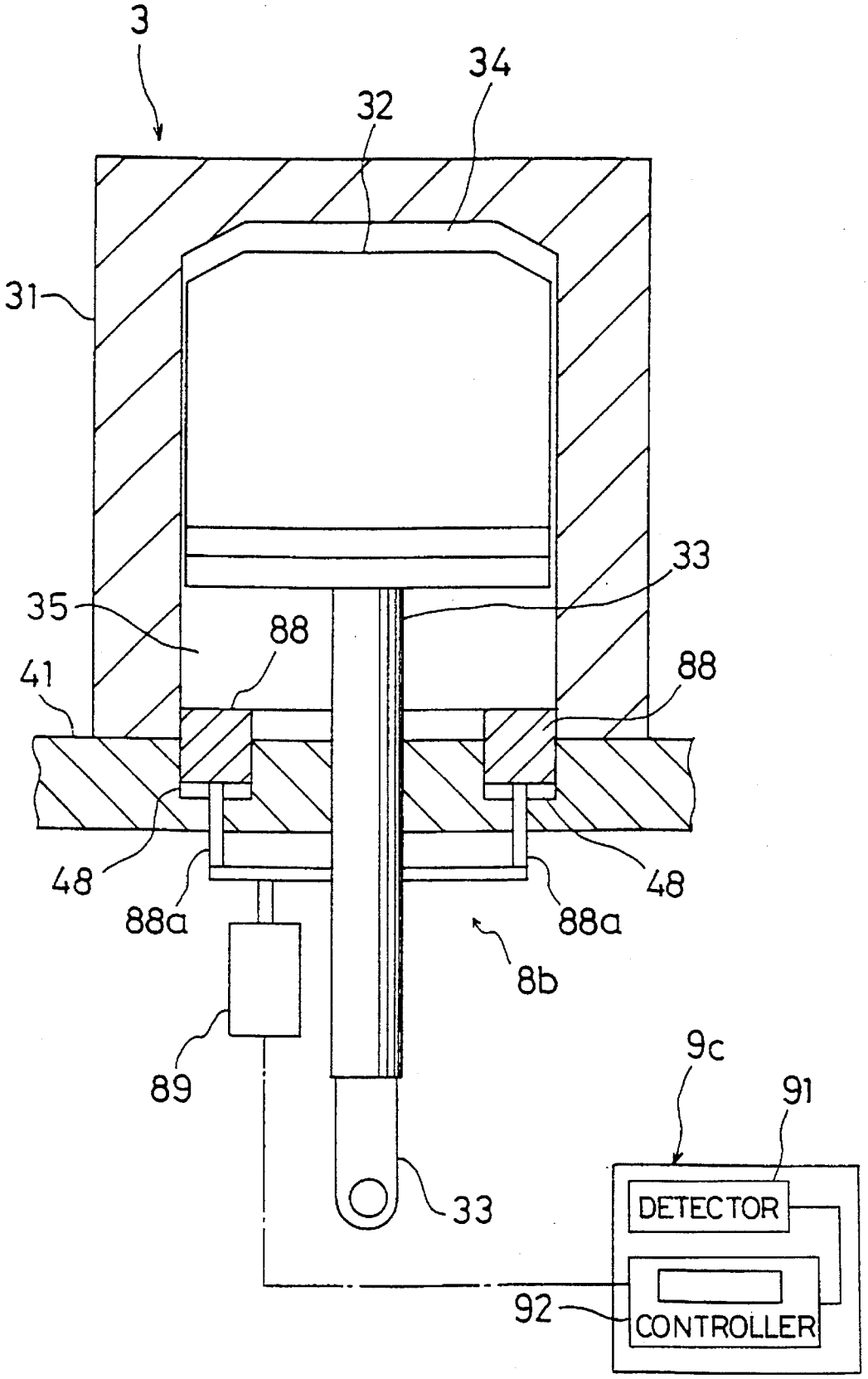
FIG. 21 is a transverse cross section of a main portion of a cold-side heat pump showing volume adjusting means in another embodiment of the present invention.

FIG. 21 shows a volume adjusting means (8*b*) in another embodiment of the present invention. The volume adjusting means (8*b*) adjusts the volume of the cold-side middle-temperature space (35).

In detail, the volume adjusting means (8*b*) is so composed that a driving means (89) is connected to an annular member (88). The annular member (88) is cylindrically formed and is inserted into an annular groove (48) of the crank case (41). The annular groove (48) is formed so as to open toward the cold-side middle-temperature space (35). The annular member (88) is provided so as to be capable of entering and leaving the cold-side middle-temperature space (35).

Further, the annular member (88) is connected to one end of an extension rod (88*a*) which passes through the crank case (41 ), and the driving means (89) such as a direct driving type motor is connected to the other end of the extension rod (88*a*).

The driving means (89) is connected to a volume control means (9*c*). The volume control means (9*c*) is composed as in the rod volume control means (9*a*) shown in FIG. 3, that is, composed of a rotation speed detector (91) and a controller (92). The controller (92) is composed so as to calculate the volume of the middle-temperature space (35) in accordance with the rotation speed N of the crank shaft (42) thereby deriving the position of the annular member (88), and so as to control the driving means (89) in order that the annular member (88) is located at the position derived. In detail, when the rotation speed N increases, the annular member (88) is moved upward in FIG. 21 to increase the amount that the annular member (88) projects into the middle-temperature space (35). When the rotation speed N decreases, the annular member (88) is moved downward to decrease the amount that the annular member (88) projects into the middle-temperature space (35).

The volume control means (9*c*) may be composed so as to, as in the rod volume control means (9*b*) shown in FIG. 20, adjust the position of the annular member (88) to control the rotation speed N of the crank shaft (42) in a feedback manner.

According to the present embodiment as described above, as in the first-mentioned embodiment shown in FIG. 3, it is not necessary to operate auxiliary driving power in a state of high-speed driving operation. Further, it is not necessary to operate a reverse load in a state of low-speed driving operation. Furthermore, since only the shaft power required to normally operate the displacers can be generated, variations of the driving speed can be reduced. In addition, since it is not necessary to change the temperature of the hot space (24), this allows an operation with a set efficiency.

In each of the above-mentioned embodiments, the volume of the rod in the cold-side heat pump (3) or the volume of the cold-side middle-temperature space (35) is changed. In the invention of any one of claims 1 to 5, however, there may be changed such as the volume of the rod in the hot-side heat pump (2).

In the invention of claim 2, the rod volume adjusting means (8*a*) is not limited to the means using the rod cover (81) and the like. The means of changing the volume of the rod by changing the rod diameter or the like can be used as the rod volume adjusting means (8*a*).

INDUSTRIAL APPLICABILITY

As described above, the vuilleumier heat pump device of the present invention can be operated with efficiency by changing the volume of the middle-temperature space, thereby being suitable for an air conditioner for performing cooling and heating operations by generating cold water and hot water.

We claim:

1. A vuilleumier heat pump device comprising:

a hot-side heat pump (2) in which an inner space of a hot side cylinder (21) is defined into a hot space (24) and a middle-temperature space (25) by a hot side displacer (22), and the hot space (24) and the middle-temperature space (25) are communicated with each other through a hot side passage (5);

a cold-side heat pump (3) in which an inner space of a cold side cylinder (31) is defined into a cold space (34) and a middle-temperature space (35) by a cold side displacer (32); the middle-temperature space (35) is communicated with the middle-temperature space (25) of the hot-side heat pump (2), and the middle-temperature space (35) and the cold space (34) are communicated with each other through a cold side passage (6);

respective rods (23, 33) connected to the respective displacers (22, 32) of the hot-side heat pump (2) and the cold-side heat pump (3) and extending to the outsides of the respective cylinders (21, 31) with passing through the respective middle-temperature spaces (25, 35);

connection means (4) for connecting both the rods (23, 33) so that both the displacers (22, 32) are reciprocated at a set phase angle;

volume adjusting means (8*a*) for changing a volume of at least one of the middle-temperature spaces (35) in the hot-side heat pump (2) and the cold-side heat pump (3); and volume control means (9*a*) for detecting a driving speed of the displacers (22, 32) and outputting, to the volume adjusting means (8*a*), a control signal for changing the volume of the middle-temperature space (35) in accordance with the driving speed.

2. The vuilleumier heat pump device according to claim 1, wherein the volume adjusting means (8*a*) is rod volume adjusting means for changing a volume of the rod (33) in at least one of the middle-temperature spaces (35).

3. The vuilleumier heat pump device according to claim 2, wherein the volume adjusting means (8*a*) has:

a adjusting motor (82) of which the rotation speed is variable in such a manner as to be controlled by the volume control means (9*a*);

a rod cover (81) which is lager in diameter than the rod (33), is passed therethrough via a screw mechanism (84) by the rod (33) and enters and leaves the middle-temperature space (35) by relative rotation with respect to the rod (33) to change the volume of the rod; and a rotation mechanism (83) connected to the adjusting motor (82), is engaged with the rod cover (81) and rotates the rod cover (81) by driving of the adjusting motor (82).

4. The vuilleumier heat pump device according to claims 2 or 3, wherein the volume control means (9*a*) is rod volume control means for calculating the volume of the rod in the middle-temperature space (35) in accordance with the driving speed of the displacers (22, 32) and outputting a control signal to the volume adjusting means (8*a*) so as to match the volume of the rod in the middle-temperature space (35) with the calculated volume of the rod.

5. The vuilleumier heat pump device according to claims 2 or 3, wherein the volume control means (9*b*) is rod volume control means for outputting, to the volume adjusting means (8*a*), a control signal for changing the volume of the rod in the middle-temperature space (35) so that the driving speed of the displacers (22, 32) is a set speed previously set.

6. The vuilleumier heat pump device according to any one of claims 1 to 5, wherein the volume adjusting means (8*a*) changes the volume of the middle-temperature space (35) in the cold-side heat pump device (3).

* * * * *